US007815581B1

(12) United States Patent
Sung

(10) Patent No.: US 7,815,581 B1
(45) Date of Patent: Oct. 19, 2010

(54) CELLULAR EXERCISE METHOD

(76) Inventor: Chien-Min Sung, 4, Lane 32, Chung-Cheng Road, Tansui, Taipei County 251 (TW)

( * ) Notice: Subject to any disclaimer, the term of this patent is extended or adjusted under 35 U.S.C. 154(b) by 706 days.

(21) Appl. No.: 11/635,376

(22) Filed: Dec. 6, 2006

Related U.S. Application Data

(63) Continuation-in-part of application No. 11/327,172, filed on Jan. 5, 2006, now abandoned.

(60) Provisional application No. 60/641,810, filed on Jan. 5, 2005.

(51) Int. Cl.
*A61H 1/00* (2006.01)
*A61H 1/02* (2006.01)
*A61H 5/00* (2006.01)

(52) U.S. Cl. ..... 601/2

(58) Field of Classification Search ..... 601/2
See application file for complete search history.

(56) References Cited

U.S. PATENT DOCUMENTS

| | | | | |
|---|---|---|---|---|
| 653,708 | A | 7/1900 | Stranger | |
| 2,970,073 | A | 1/1961 | Prange | |
| 3,063,444 | A | 11/1962 | Jobst | |
| 3,113,761 | A | 12/1963 | Platzman | |
| 3,288,132 | A | 11/1966 | Meredith | |
| 3,499,436 | A * | 3/1970 | Balamuth | 601/2 |
| 3,499,437 | A | 3/1970 | Balamuth | |
| 3,577,977 | A | 5/1971 | Ritzinger, Jr. et al. | |
| 3,585,991 | A | 6/1971 | Balamuth | |
| 3,776,223 | A | 12/1973 | Yeager et al. | |
| 4,181,124 | A | 1/1980 | Pauletich | |
| 4,216,766 | A | 8/1980 | Duykers et al. | |
| 4,217,892 | A | 8/1980 | Brill | |
| 4,315,514 | A | 2/1982 | Drewes et al. | |
| 4,722,332 | A | 2/1988 | Saggers | |
| 4,787,394 | A | 11/1988 | Ogura | |
| 4,815,452 | A | 3/1989 | Hayek | |
| 4,838,263 | A | 6/1989 | Warwick et al. | |
| 4,917,095 | A | 4/1990 | Fry et al. | |
| 4,942,868 | A | 7/1990 | Vago | |
| 4,945,901 | A | 8/1990 | Burcke | |
| 5,042,479 | A | 8/1991 | Brotz | |
| 5,048,520 | A | 9/1991 | Vago | |
| 5,178,134 | A | 1/1993 | Vago | |

(Continued)

OTHER PUBLICATIONS

FootSmart: Shop for Air compression legs, Website Address: http://www.footsmart.com/pRODUCT.ASPX?pRODUCTiD=216, print date Aug. 18, 2004, p. 1.

(Continued)

*Primary Examiner*—Brian Casler
*Assistant Examiner*—James Kish
(74) *Attorney, Agent, or Firm*—Thorpe North & Western LLP

(57) ABSTRACT

A method for exercising cells within a body is provided, including selecting a portion of the body to receive cellular exercise, enclosing the portion of the body with a covering to form an essentially watertight space in contact with the portion of the body, introducing into the watertight space a liquid, such that the liquid is in contact with the portion of the body, and introducing sound waves into the liquid. Various embodiments of the present invention include pressurizing the essentially watertight space.

18 Claims, 2 Drawing Sheets

U.S. PATENT DOCUMENTS

| | | | |
|---|---|---|---|
| 5,305,737 | A | 4/1994 | Vago |
| 5,339,804 | A | 8/1994 | Kemp |
| 5,453,081 | A | 9/1995 | Hansen |
| 5,520,612 | A | 5/1996 | Winder et al. |
| 5,665,141 | A | 9/1997 | Vago |
| 5,702,353 | A | 12/1997 | Guzzini et al. |
| 5,741,317 | A | 4/1998 | Ostrow |
| 5,762,616 | A | 6/1998 | Talish |
| 6,004,257 | A | 12/1999 | Jacobson |
| 6,027,464 | A | 2/2000 | Dahlquist |
| 6,156,549 | A | 12/2000 | Drewes et al. |
| 6,190,337 | B1 | 2/2001 | Nedwell |
| 6,436,060 | B1 | 8/2002 | Talish |
| 6,450,979 | B1 | 9/2002 | Miwa et al. |
| 6,488,641 | B2 | 12/2002 | Hansen |
| 6,547,749 | B2 | 4/2003 | Hansen |
| 6,790,187 | B2 | 9/2004 | Thompson et al. |
| 6,974,425 | B2 | 12/2005 | Rogers et al. |
| 2005/0075587 | A1 | 4/2005 | Vago |

OTHER PUBLICATIONS

Mego Afek: Flow Control Systems for Health and Industry, Website Address: http://www.megoafek.co.il/html/history.htm, print date Aug. 18, 2004, pp. 1-2.

* cited by examiner

CELLULAR EXERCISE METHOD

PRIORITY DATA

This application is a continuation in part of U.S. patent application Ser. No. 11/327,172, filed on Jan. 5, 2006, which claims the benefit of U.S. Provisional Patent Application Ser. No. 60/641,810, filed on Jan. 5, 2005, both of which are incorporated herein by reference.

FIELD OF THE INVENTION

The present invention relates generally to devices and methods for improving cellular metabolism. Accordingly, the present invention involves the fields of medical devices, cellular biology, and medicine.

BACKGROUND OF THE INVENTION

Cellular metabolism inevitably produces waste in an organism. Most waste products are properly excreted from the body as part of general metabolic processes. Sometimes, however, a portion of these waste substances collect within the body. These waste products are often toxic, producing various negative health issues for humans when they collect and are not excreted. Often these toxic substances collect in the cellular cytoplasm or in the interstitial fluid between cells. Many factors including inadequate fluid intake and sedentary lifestyles may exacerbate such a buildup of waste products.

It has been supposed that movement and exercise may assist in the elimination of many cellularly derived waste products. General bodily movement tends to cause layers of tissue to move relative to each other, and such movement may act to compress cellular cytoplasm and interstitial fluids, thus causing increased mobility of toxins and more efficient elimination and excretion. Many structures in the body, however, contain cellular regions that exhibit little movement in response to exercise or motion of the body. Examples may include internal organs, layers of connective tissue, and layers of adipose tissue. Additionally, many individuals may be incapable or reluctant to exercise, and thus a larger proportion of their tissue may collect unhealthy levels of cellularly derived waste products.

Waste products and toxins collected within bodily tissues may have numerous negative health effects. For example, high toxin concentrations in the interstitial fluid or the cytoplasm may stress or otherwise cause damage to cellular structures, thus causing tissue to age at an accelerated rate. Also, high concentrations of toxins in the interstitial fluid may affect cellular transport mechanisms, or affect concentration gradients established across cellular membranes. Cells may be less efficient in performing specific roles, thus taxing various physiological processes.

As such, it would beneficial to provide a way of exercising at the cellular level, such that toxins and cellular waste products would be more efficiently excreted from the body.

SUMMARY OF THE INVENTION

It has been recognized that it would be advantageous to develop a method for exercising cells within a body, such that cellular toxins and waste may be more efficiently eliminated.

The invention provides a method for exercising cells within a subject's body, including selecting a portion of the body to receive cellular exercise, enclosing the portion of the body with a covering to form an essentially watertight space in contact with the portion of the body, introducing a liquid into the watertight space, such that the liquid is in contact with the portion of the body, and introducing sound waves into the liquid. In one aspect, the sound waves may be ultrasound waves. Additionally, various embodiments of the present invention include pressurizing the essentially watertight space.

In another embodiment of the present invention, a method for exercising cells within a subject's body is provided. The method may include enclosing a portion of the body with a liquid, and introducing pressure waves into the liquid to produce pressure fluctuations against the portion of the body.

Additional features and advantages of the invention will be apparent from the detailed description which follows, taken in conjunction with the accompanying drawings, which together illustrate, by way of example, features of the invention.

DETAILED DESCRIPTION

Definitions

Figure 1:
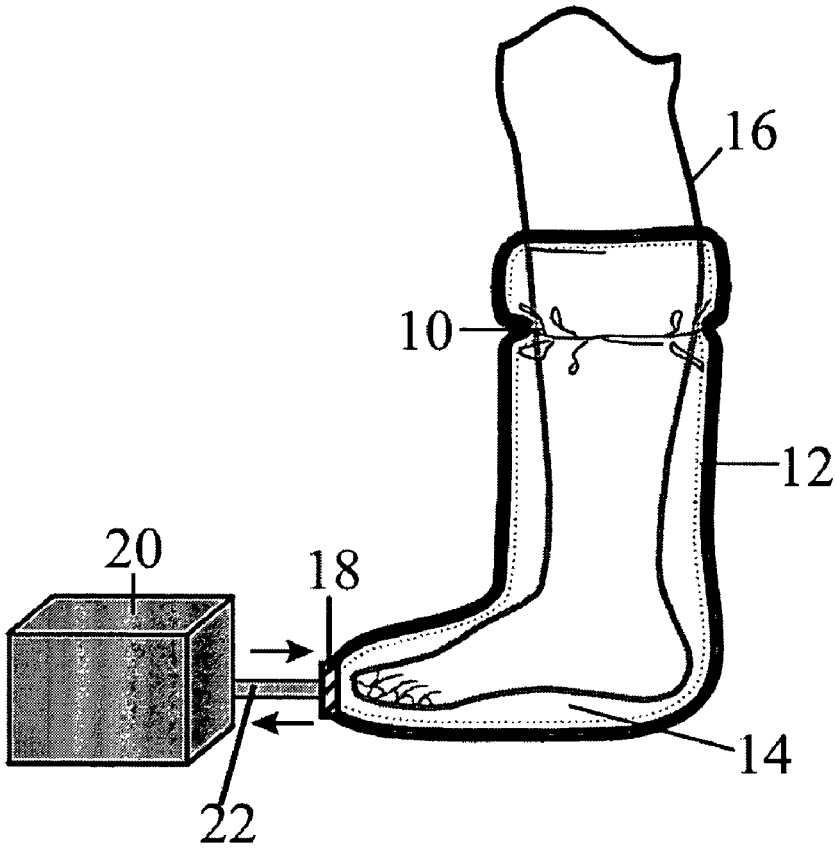
FIG. 1 is a perspective view of a cellular exercise device in accordance with an embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a limb" includes reference to one or more of such limbs, and reference to "a liquid" includes reference to one or more of such excipients.

As used herein, "subject" refers to a mammal that may benefit from the administration of a drug composition or method of this invention. Examples of subjects include humans, and may also include other animals such as horses, pigs, cattle, dogs, cats, rabbits, and aquatic mammals.

As used herein, "substantially" when used in reference to a quantity or amount of a material, or a specific characteristic thereof, refers to an amount that is sufficient to provide an effect that the material or characteristic was intended to provide. The exact degree of deviation allowable may in some cases depend on the specific context.

The term "cellular exercise" refers to any stimulus impinging on cellular tissue that causes movement or vibration at a cellular or subcellular level. Cellular exercise would include also include relative movement between individual cells, as well as relative movement between layers or regions of tissue.

As used herein, the term "watertight" refers to the substantial containment of a liquid within a space. In one aspect, a watertight space may be completely watertight and thus not allow any significant amount of liquid leakage. In another aspect, a watertight space may be a space that substantially contains the liquid, but may allow for some leakage.

As used herein, the term "hydrostatic pressure" refers to the transfer of acoustic or other mechanical energy through a liquid or fluid medium.

As used herein, the term "irregular frequency" refers to a frequency that cannot be defined by a single frequency value.

This may include frequencies that are random, pseudorandom, rhythmic combinations of multiple frequencies, or any other waveform that can contains more than one frequency component.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

The Invention

Reference will now be made to exemplary embodiments, including those illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides methods for enhancing the movement and subsequent elimination of cellular waste and toxins from the body. This may be accomplished by applying hydrostatic pressure to a portion of the body or the entire body. The application of hydrostatic pressure may cause cells within the body to move with respect to adjacent cells. This movement or "cellular exercise" may act to increase the mobility of cellular cytoplasm and interstitial fluid, thus facilitating a more rapid elimination of waste products.

As such, one embodiment of the present invention provides a method of exercising cells in a body. The method may include selecting a portion of the body to receive cellular exercise and enclosing the portion of the body with a covering. The covering may be configured such that it forms an essentially watertight space that is in contact with the portion of the body. The method may further include introducing into the watertight space a liquid, such that the liquid is in contact with the portion of the body. Sound waves, including ultrasonic waves, can then be introduced into the liquid in order to exercise the cells. In one aspect, the essentially watertight space may be pressurized to facilitate the transmission of sound waves to the selected portion of the body.

The embodiments of the present invention contemplate a wide variety of portions of the body that can derive benefit therefrom. For example, embodiments may encompass a limb such as an arm or a leg, or a portion of a limb such as a hand, a shoulder, a foot, or a thigh. Embodiments may also encompass larger portions of the body, such as the torso, or the hips and legs. Similarly, embodiments may encompass essentially the entire body, including the head, provided that breathable air is supplied to the recipient of the cellular exercise.

An example embodiment of a device to provide the benefits of the present invention to the lower leg and foot is shown in FIG. 1. It should be noted that the concepts shown can be incorporated into similar devices for use on other parts of the body. The device 10 comprises a covering 12 configured such that it forms an essentially watertight space 14 that is in contact with the portion of the body 16, in this case a leg. The liquid is introduced into the essentially watertight space 14, and sound or ultrasound waves are generated in the liquid by means of a sound or ultrasound generator 18. In embodiments where the essentially watertight space 14 is pressurized, the device may also contain a pressurization device 20 where liquid is introduced via an inlet/outlet tube 22.

The covering 12 may be constructed of any material capable of forming an essentially watertight seal that is known to one of ordinary skill in the art, including, but not limited to, rubber, plastic, neoprene, and combinations thereof. It is also contemplated that the covering 12 may be constructed of a combination of flexible and nonflexible materials. It also may be beneficial to construct the covering 12 with sufficient rigidity such that hydrostatic pressure can build up in the liquid without being dissipated by the flexible nature of the flexible cover. In other words, the covering 12 can be flexible enough to contain the liquid, but rigid enough to allow a build-up of hydrostatic pressure. Alternatively, the device may be constructed of a first material that is flexible enough to create a watertight seal, and a second material that is rigid enough to contain the liquid.

It is preferable that the space 14 between the covering 12 and the portion of the body 16 be watertight and thus not leak, especially when the space will be pressurized. It is to be understood, however, that certain embodiments of the present invention may generate a certain amount of leakage, especially considering the wide variety of body shapes to which this embodiment of the present invention may be applied. The leakage should be slow enough that sufficient liquid is maintained in the watertight space to facilitate the transmission of sound or pressure waves to the body surface. In one aspect, the leakage may be countered by the introduction of additional liquid into the watertight space 14. In another embodiment, the covering may be configured such that the liquid is wholly contained therein, and the liquid does not come in contact with the surface of the body. In this case, the sound or pressure waves would be transmitted from the liquid through the covering and into the portion of the body selected for the cellular exercise. By fully enclosing the liquid in the covering, the present invention may be practiced with less mess than embodiments in which the liquid is in direct contact with the surface of the body. However, embodiments that utilize self-contained liquids may not allow herbal mixtures and other potentially beneficial mixtures to come in contact with the skin. Also, transmission of sound or pressure waves to the skin may be decreased due to transmission through another layer of flexible material next to the body surface.

Another embodiment of the present invention provides a method of exercising cells in a body. The method includes enclosing a portion of the body with a liquid, and introducing sound waves into the liquid, such that the sound waves produce pressure fluctuations against the portion of the body. The portion of the body may be enclosed with liquid using any means known to one of average skill in the art that maintains the liquid in a spatial relationship with the body surface. Examples may include a covering as described herein, or a container filled with the liquid into which a portion of the body may be submerged. It may be useful for embodiments utilizing a container filled with liquid to include a cover so that the container may be pressurized to facilitate the transmission of the pressure waves. In one embodiment of the present invention, the liquid is held in a self-contained space in close proximity to the surface of the body. Such a configuration allows the transmission of pressure waves through the liquid and into the body tissue, while preventing direct contact between the liquid and the body. The self-contained space may be a bladder used to direct pressure waves from a particular direction, or a sleeve or bag that encompasses large regions or appendages of the body. The liquid in the self-contained space may be pressurized to facilitate the transmission of pressure waves.

Figure 2:
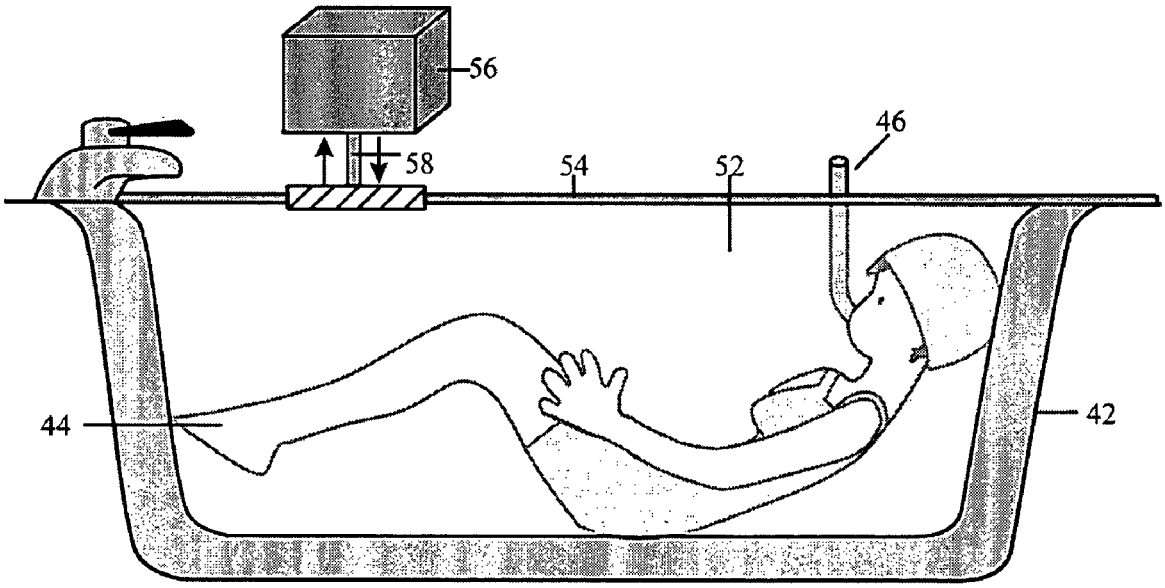
FIG. 2 is a cross-sectional view of a cellular exercise device in accordance with an embodiment of the present invention.

It is also contemplated that essentially the entire body may be submerged in a container filled with the liquid in order to obtain a whole body benefit from the present invention. FIG. 2 is illustrative of one example embodiment 40. A tank 42 contains a liquid 52 as described herein, and is of a sufficient size to allow essentially an entire body of a person 44 to be submerged therein. A breathing apparatus 46 provides air to the person 44 while submerged in the tank 42. A sound or ultrasound generator 50 introduces sound waves into the liquid 52, which are propagated throughout the body of the person 44. In one embodiment of the present invention, a cover 54 may be secured over the top of the tank 42 in order to pressurize the tank. Controls 48 may be included inside the tank 42 to allow the person 44 to control the sound or ultrasound generator 50, to pressurize and depressurize the tank 42, and to open the cover 54. Pressurization can occur via a pressurization device 56 coupled to the tank 42 by a liquid inlet 58. In another embodiment, the tank 42 may be pressurized by a pressurization device that introduces a gas into the tank 42. In one embodiment of the present invention, essentially the entire body may be covered with a thin flexible material prior to submersion in the tank. This configuration would allow an individual to achieve the benefits of whole-body cellular exercise without needing to come in contact with the fluid.

In another aspect of the present invention, liquid jets 43 may be coupled to the tank 42 of FIG. 2. The jets can circulate the liquid in the tank 42 to create turbulence in the liquid, and thus introduce a non-hydrostatic component to the pressurized system.

Figure 3:
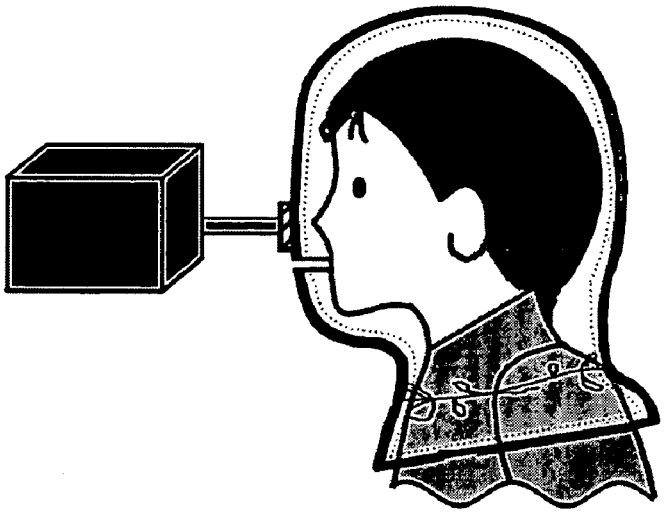
FIG. 3 is a perspective view of a cellular exercise device in accordance with an embodiment of the present invention.

Another aspect of the present invention is shown in FIG. 3. This aspect illustrates a device 60 enclosing the head. The device comprises a covering 62 that encloses a liquid in an essentially watertight space 64. A breathing tube 66 is included to allow breathing. Sound or ultrasound waves are generated by a sound or ultrasound generator 67 coupled to the covering 62. The liquid can be pressurized by a pressurization device 68 coupled to the covering 62 via an inlet/outlet tube 70.

Figure 4:
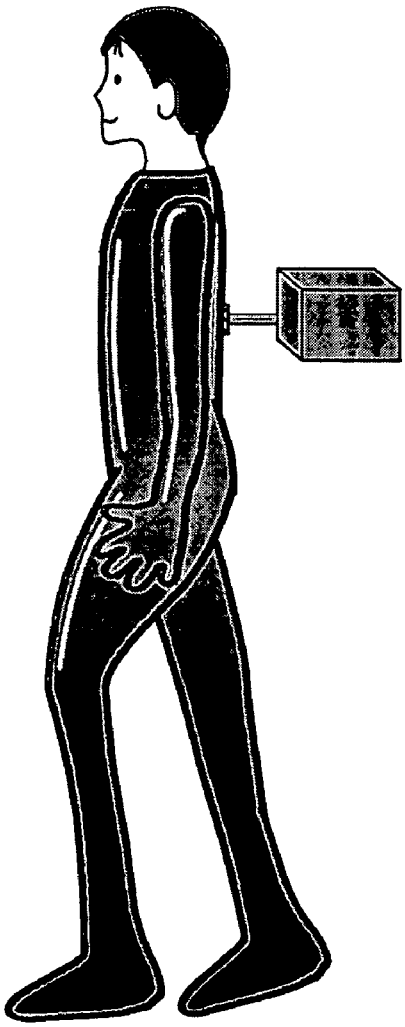
FIG. 4 is a perspective view of a cellular exercise device in accordance with an embodiment of the present invention.

Yet another aspect of the present invention is illustrated in FIG. 4. This aspect shows a suit device 80. The suit device is configured of a covering 82 constructed of a material as described herein, with a sound or ultrasound generator 84 coupled thereto. The suit device also may contain a liquid in an essentially watertight space (not shown). The liquid can be pressurized by means of a pressurization device 86 coupled to the suit device by an inlet/outlet tube 88.

Numerous liquids may be utilized for the transmission of pressure waves in embodiments of the present invention. Examples include, essentially pure water, mineral waters, herbal mixtures in a liquid medium, oils, gels, liquefied muds and pastes, plant extracts, lotions, alcohols, cosmetics, medicinals, and mixtures thereof. Specific types of liquids may provide more benefit to one embodiment over another. For example, greater benefit from herbal mixtures may be derived from embodiments in which the liquid is in direct contact with the surface of the body. Also, dissolution and diffusion of a medicinal through the skin may be facilitated by the pulsating liquid as described herein.

Any means or mechanism of generating pressure waves known to one of ordinary skill in the art may be utilized to introduce hydrostatic pressure waves into the liquid. For example, in one embodiment, piezoelectric material may be utilized to introduce pressure waves into the liquid by electromechanical means. It may be integral to the flexible covering or simply attached thereto. The piezoelectric material may directly transmit mechanical movement to the flexible covering or to the tank, or it may transmit the mechanical movement by way of an intervening air or other fluid space, and thus be considered a sound producing device.

The following discussion describes sound waves that are utilized to generate pressure waves or fluctuations in the liquid. It should be understood that any means used to generate pressure waves in the frequencies described herein should be considered to be within the scope of the present invention.

In the present invention, sound waves propagated in a liquid create hydrostatic pressure that is perpendicular to the surface of the body, comprising primarily a longitudinal movement. As such, there is no shear component to the sound waves when moving in liquid. When the waves propagate into the semi-solid body, cellular movement creates a secondary wave comprising a shear component. Many cells contacted by the sound waves will move relative to one another at a rate that is proportional to the frequency of the delivered sound, and thus cause rapid compression and decompression in localized regions surrounding the cells that act to increase the movement and thus the expulsion of cellular waste products.

Also, different frequencies and amplitudes of sound waves may be used to exercise different cells at different depths under the skin. In general, higher frequencies and larger amplitudes tend to propagate further into bodily tissue. Specific frequencies and amplitudes may also create standing waves with strong compression or decompression characteristics in specific locations. In another aspect, chaotic waves can be utilized to produce various generalized cellular exercise benefits.

In one embodiment of the present invention, the pressure waves can be sound waves, including waves in the ultrasonic and subsonic range. The acoustic characteristics of the waves can be altered to suit personal preferences of the recipient of the cellular exercise, or they may be modified to obtain a specific physiological effect, e.g., dislodging cholesterol buildup in veins. Ultrasound is sound with a frequency greater than about 20 kilohertz, approximately the upper limit of human hearing. Although the term "sound waves" may include waves in the ultrasound range, sound waves may also include waves having a frequency from approximately the upper range of human hearing to just below human hearing, or in other words, from about 1 hertz to about 20 kilohertz.

The ultrasound waves can be delivered as a simple ultrasound waveform, or they can contain some form of modulation. For example, the ultrasound can be amplitude modulated, frequency modulated, or both amplitude and frequency modulated. In one embodiment, the ultrasound wave can be amplitude modulated with an amplitude modulating wave having a frequency of from about 20 hertz to about 20 kilohertz, corresponding to the approximate range of human hearing. In another embodiment, the amplitude modulating wave can have a frequency in the ultrasound range, namely, greater than about 20 kilohertz. In yet another embodiment, the amplitude modulating wave can have a frequency of less than about 20 kilohertz. In a further embodiment, the amplitude modulating wave may have a frequency of greater than about 1000 hertz and less than about 10 kilohertz. It is also conceivable that the ultrasound wave can be modulated with multiple amplitude modulating waves, and it should be understood that the multiple amplitude modulating waves may have frequencies in one or both of the aforementioned acoustic ranges. Thus, in an additional embodiment, the amplitude modulating wave may have an irregular frequency.

In another embodiment of the present invention, the ultrasound wave can be frequency modulated with a frequency modulating wave. In one aspect, such a waveform may have frequency of greater than about 20 kilohertz. In another aspect, the frequency modulating wave may have a frequency of from about 20 hertz to about 20 kilohertz. In yet another aspect, the frequency modulating wave may have a frequency greater than about 20 kilohertz. In a further aspect, the frequency modulating wave may have a frequency less than about 20 kilohertz. In an additional aspect, the frequency modulating wave may have a frequency of greater than about 1000 hertz and less than about 10 kilohertz. It is also conceivable that the ultrasound wave can be modulated with multiple frequency modulating waves, and it should be understood that the multiple frequency modulating waves may have frequencies in one or both of the aforementioned acoustic ranges. Thus, in an additional embodiment, the frequency modulating wave may have an irregular frequency.

In yet another embodiment of the present invention, the ultrasound wave can be amplitude modulated and frequency modulated with an amplitude modulating wave and a frequency modulating wave. Both the amplitude modulating wave and the frequency modulating wave can be a single or multiple waves, and both can have frequencies in either or both of the aforementioned acoustic ranges. The mechanics of ultrasound manipulation by both amplitude and frequency modulation is well within the knowledge of one of average skill in the art.

As has been described, the sound waves according to aspects of the present invention may be presented with a variety of pressures. In one aspect, higher pressures may more effectively generate the beneficial effects of the present invention in a subject. For example, in one specific aspect, the sound wave or other pressure wave may be delivered with an amplitude or a pressure having an approximate hydrostatic equivalent of from about 1 to about 200 meters under water.

Any means know to one skilled in the art to produce sound, including ultrasound, is considered to be within the scope of the present invention. As such, the descriptions herein are merely illustrative, and not meant to be limiting. The frequency of the sound waves can be controlled by a solenoid or tweeter diaphragm driven by an AC current or an intermittent DC current. Vibrations in the ultrasound range can also be generated using a piezoelectric material. The amplitude of the ultrasound can be controlled by the scale of the motion of the material creating the vibration.

In some aspects, the desired amplitude or pressure of a sound wave to be delivered to a subject may be greater that what would be allowed by a piezoelectric device. In such cases, higher hydrostatic pressures may be achieved using mechanical devices such as pistons or solenoids. Additionally, by sealing the space containing the water and/or by utilizing a housing material that is relatively rigid, higher levels of pressure may be delivered and maintained.

Furthermore, it is intended that frequencies and intensities of pressure and sound waves should be used that are sufficient to provide a benefit to the body without damaging tissue or rupturing cells. Also, comfortable intensity and frequency ranges may vary between individuals, and may be configurable depending on personal preference.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A method for exercising cells within a subject's body, comprising:

selecting a portion of the body to receive cellular exercise;

enclosing the portion of the body with a flexible covering to form an essentially watertight space in contact with the portion of the body;

introducing a liquid into the watertight space, such that the liquid is in contact with the portion of the body; and introducing sound waves into the liquid.

2. The method of claim 1, wherein the liquid is essentially water.

3. The method of claim 1, wherein the liquid contains an herbal mixture.

4. The method of claim 1, wherein the portion of the body is at least about 50% of the body.

5. The method of claim 1, wherein the portion of the body is essentially all of the body, excluding the head.

6. The method of claim 1, wherein the portion of the body is essentially all of the body, including the head.

7. The method of claim 1, wherein the portion of the body is at least a portion of a limb.

8. The method of claim 1, wherein the sound waves are amplitude modulated with an amplitude modulating wave.

9. The method of claim 8, wherein the amplitude modulating wave has a frequency of greater than about 20 kilohertz.

10. The method of claim 8, wherein the amplitude modulating wave has a frequency of less than about 20 kilohertz.

11. The method of claim 8, wherein the amplitude modulating wave has a frequency of greater than about 1000 hertz and less than about 10 kilohertz.

12. The method of claim 8, wherein the amplitude modulating wave has an irregular frequency.

13. The method of claim 1, wherein the sound waves are frequency modulated with a frequency modulating wave.

14. The method of claim 13, wherein the frequency modulating wave has a frequency of greater than about 20 kilohertz.

15. The method of claim 13, wherein the frequency modulating wave has a frequency of less than about 20 kilohertz.

16. The method of claim 13, wherein the frequency modulating wave has a frequency of greater than about 1000 hertz and less than about 10 kilohertz.

17. The method of claim 13, wherein the frequency modulating wave has an irregular frequency.

18. The method of claim 1, wherein the sound waves are ultrasound waves.

* * * * *